US012290735B1

(12) United States Patent
Raslavich

(10) Patent No.: US 12,290,735 B1
(45) Date of Patent: May 6, 2025

(54) WHEEL GUARD DEVICE FOR STATIONARY EXERCISE BICYCLE

(71) Applicant: Anna Raslavich, Tampa, FL (US)

(72) Inventor: Anna Raslavich, Tampa, FL (US)

(73) Assignee: Benjamin Raslavich, Tampa, FL (US)

( * ) Notice: Subject to any disclaimer, the term of this patent is extended or adjusted under 35 U.S.C. 154(b) by 261 days.

(21) Appl. No.: 18/075,030

(22) Filed: Dec. 5, 2022

Related U.S. Application Data

(60) Provisional application No. 63/293,951, filed on Dec. 27, 2021.

(51) Int. Cl.
*A63B 71/00* (2006.01)
*A63B 22/06* (2006.01)

(52) U.S. Cl.
CPC ..... *A63B 71/0054* (2013.01); *A63B 22/0605* (2013.01); *A63B 2071/009* (2013.01)

(58) Field of Classification Search
CPC ..... A63B 2069/161; A63B 2069/162; A63B 2069/163; B62J 15/02; B62J 15/00
See application file for complete search history.

(56) References Cited

U.S. PATENT DOCUMENTS 746,603 A * 12/1903 Taylor ..... B62J 7/04 280/847
1,027,806 A * 5/1912 Blake ..... B62J 15/02 280/152.2
3,101,163 A * 8/1963 Huber ..... B62J 21/00 224/430
4,026,546 A * 5/1977 Omori ..... A63B 69/16 482/61
4,852,872 A * 8/1989 Lo ..... A63B 21/157 74/48
5,048,824 A * 9/1991 Chen ..... A63B 21/0088 482/73
6,152,861 A * 11/2000 Chen ..... A63B 22/0605 482/57
2002/0070525 A1* 6/2002 Smerdon, Jr. ..... B62J 15/00 280/152.1
2005/0250623 A1* 11/2005 Chen ..... A63B 21/4049 482/63
2010/0164195 A1* 7/2010 Chuang ..... B62J 15/02 280/152.1
2012/0266719 A1* 10/2012 Southerland ..... F16P 1/02 74/612

FOREIGN PATENT DOCUMENTS

DE 4232687 A1 * 3/1994 ..... B62J 15/00

* cited by examiner

*Primary Examiner* — Daniel D Yabut
(74) *Attorney, Agent, or Firm* — John Rizvi; John Rizvi, P.A.—The Patent Professor ®

(57) ABSTRACT

A wheel guard device comprises a coupling module, a shielding module and a supporting module. The shielding module is connected in between the coupling module and the supporting module. The coupling module is configured to be connected with an upper portion of a bicycle frame of the stationary exercise bicycle. The shielding module is configured to at least partially surround a bicycle wheel of the stationary exercise bicycle with a predetermined distance from the bicycle wheel. The supporting module is configured to be placed on a ground or a mounting/supporting surface, or be connected with a lower portion of the bicycle frame.

16 Claims, 5 Drawing Sheets

WHEEL GUARD DEVICE FOR STATIONARY EXERCISE BICYCLE

CROSS-REFERENCE TO RELATED APPLICATIONS

This application claims the benefit of U.S. Provisional Patent Application Ser. No. 63/293,951, filed on Dec. 27, 2021, which is incorporated herein in its entirety.

FIELD OF THE INVENTION

The present invention relates generally to a bicycle accessory, and more particularly, to a wheel guard device for a stationary exercise bicycle.

BACKGROUND OF THE INVENTION

A bicycle, also called a bike or cycle, is a human-powered or motor-powered, pedal-driven, single-track vehicle, having two wheels attached to a frame, one behind the other. A bicycle rider is called a cyclist, or bicyclist.

Bicycles are the principal means of transportation in many regions. They also provide a popular form of recreation, and have been adapted for use as children's toys, general fitness, military and police applications, courier services, bicycle racing, and bicycle stunts.

The bicycle's invention has had an enormous effect on society, both in terms of culture and of advancing modern industrial methods. Several components that eventually played a key role in the development of the automobile were initially invented for use in the bicycle, including ball bearings, pneumatic tires, chain-driven sprockets and tension-spoked wheels.

A stationary bicycle (also known as exercise bicycle, exercise bike, spinning bike, or exercycle) is a device used as exercise equipment for indoor cycling. It includes a saddle, pedals, and some form of handlebars arranged as on a (stationary) bicycle.

A stationary bicycle is usually a special-purpose exercise machine resembling a bicycle. It is also possible to adapt an ordinary bicycle for stationary exercise by placing it on bicycle rollers or a trainer. Rollers and trainers are often used by racing cyclists to warm up before racing, or to train on their own machines indoors.

Some models feature handlebars that are connected to the pedals so that the upper body can be exercised along with the lower body. Most exercise bikes provide a mechanism for applying resistance to the pedals which increases the intensity of the exercise. Resistance mechanisms include magnets, fans, and friction mechanisms. Some models allow the user to pedal backwards to exercise antagonist muscles which are not exercised in forward pedaling. Exercise bicycles are typically manufactured using a crankshaft and bottom bracket, which turns a flywheel by means of a belt or chain. The bearings on these moving parts wear with use and may require replacement.

Specialized indoor bicycles manufactured using a weighted flywheel at the front are used in the indoor cycling exercises called spinning.

Various types of indoor mini-cycles (also known as exercise pedallers) have also developed as portable, inexpensive alternatives to traditional stationary bicycles. They are useful when exercisers are unable to access their stationary bicycles from their homes or local gyms when traveling or at work.

Exercise bikes are used for exercise, to increase general fitness, for weight loss, and for training for cycle events. The exercise bike has long been used for physical therapy because of the low-impact, safe, and effective cardiovascular exercise it provides. The low-impact movement involved in operating an exercise bike does not put much stress on joints and does not involve sporadic motions that some other fitness equipment may require.

Stationary bikes are also used for physical testing, i.e. as ergometers for measuring power. Traditionally this is done by imposing a certain level of resistance mechanically. Modern ergometers and even many consumer exercise bikes are fitted with electronic sensors and displays.

Mini-cycles offer exercisers low intensity physical activities that helps burn calories, helps moderate blood sugar levels, help combat cholesterol, provides gentle toning, keeps joints mobile through gentle use and improves general circulation. They are also often used by people for rehabilitation purposes after suffering physical injuries.

However, a front bicycle wheel of a stationary exercise bicycle is exposed and is very dangerous when spinning really fast. People around the fast-spinning bicycle wheel might get hurt.

Accordingly, there is need for a solution to at least one of the aforementioned problems.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

The present invention is directed to a wheel guard device.

In an embodiment of the present invention, the wheel guard device comprises a coupling module, a shielding module and a supporting module.

In this embodiment of the present invention, the shielding module is connected in between the coupling module and the supporting module.

In this embodiment of the present invention, the coupling module is configured to be connected with an upper portion of a bicycle frame of the stationary exercise bicycle.

In this embodiment of the present invention, the shielding module is configured to at least partially surround a bicycle wheel of the stationary exercise bicycle with a predetermined distance from the bicycle wheel.

In this embodiment of the present invention, the supporting module is configured to be placed on a ground or a mounting/supporting surface, or be connected with a lower portion of the bicycle frame.

In this embodiment of the present invention, the coupling module comprises a strap element. The strap element is configured to be connected with the upper portion of the bicycle frame.

In this embodiment of the present invention, the coupling module comprises a brace element. The brace element is configured to be connected with the upper portion of the bicycle frame.

In this embodiment of the present invention, the shielding module comprises a shielding element. The shielding element is configured to at least partially surround the bicycle wheel.

In this embodiment of the present invention, the supporting module comprises a plurality of adjustable supporting legs. The plurality of adjustable supporting legs are used to be placed on a ground or a mounting/supporting surface, or be connected with the lower portion of the bicycle frame.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and sub-combinations described in the detailed description.

These and other objects, features, and advantages of the present invention will become more readily apparent from the attached drawings and the detailed description of the preferred embodiments, which follow.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

The preferred embodiments of the invention will hereinafter be described in conjunction with the appended drawings provided to illustrate and not to limit the invention, where like designations denote like elements, and in which:

Figure 1:
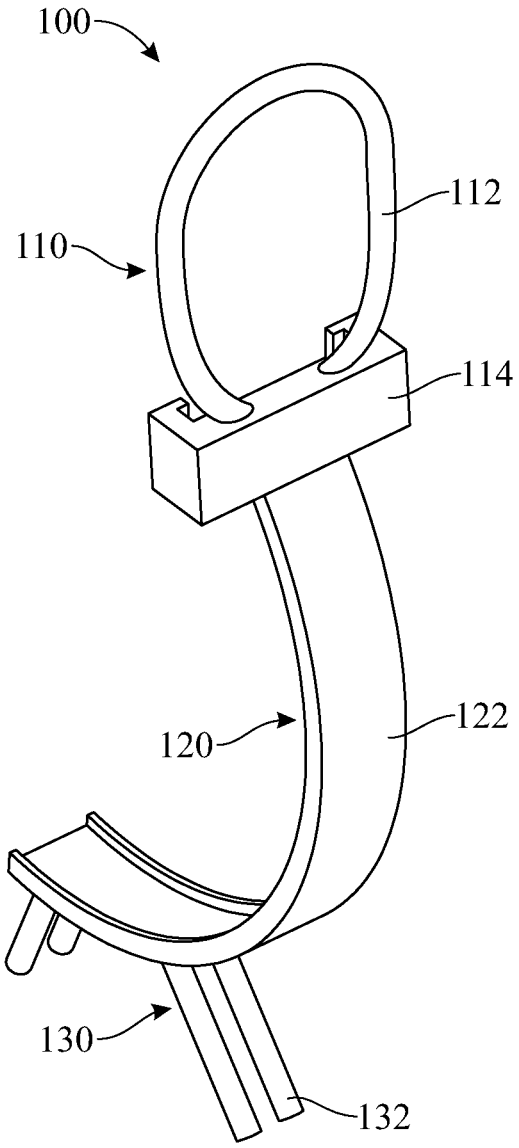
Figure 2:
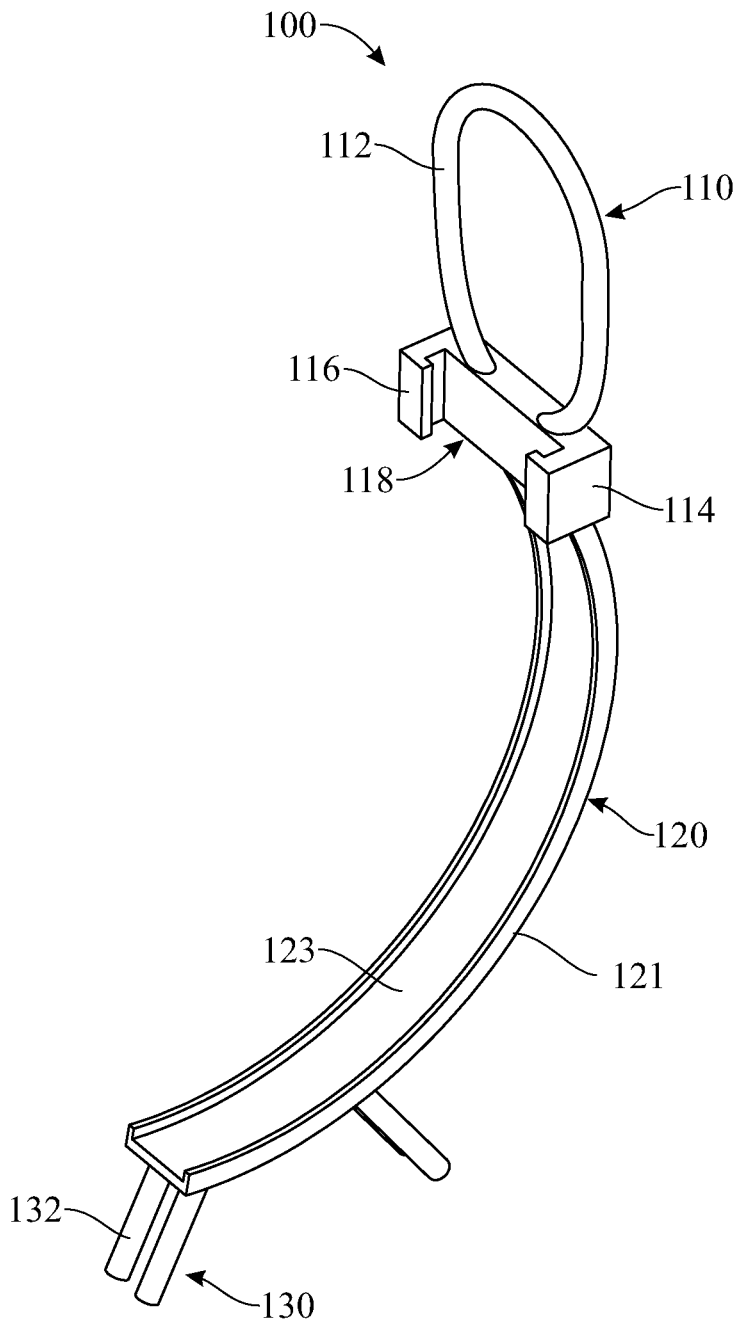
Figure 3:
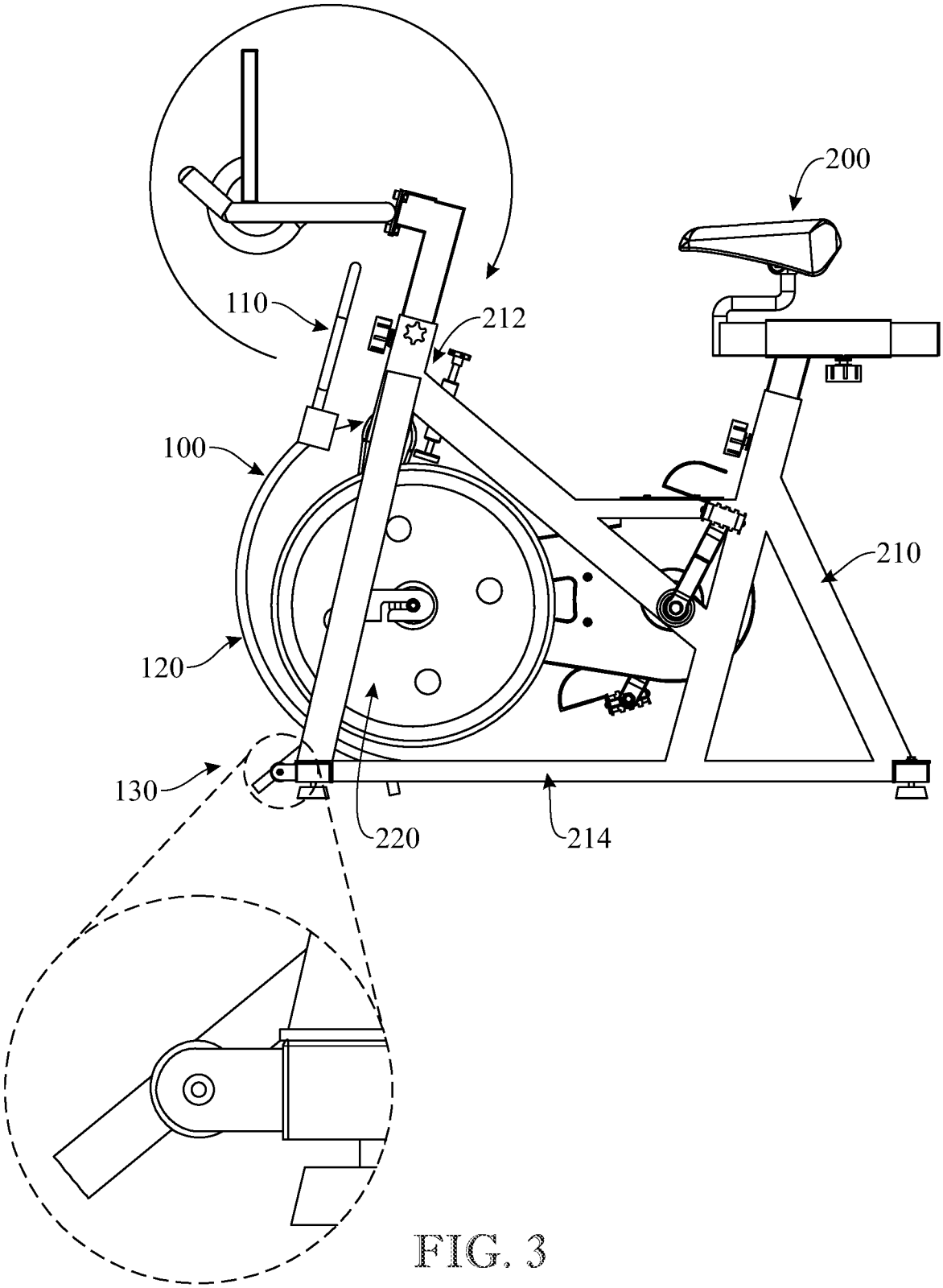
Figure 4:
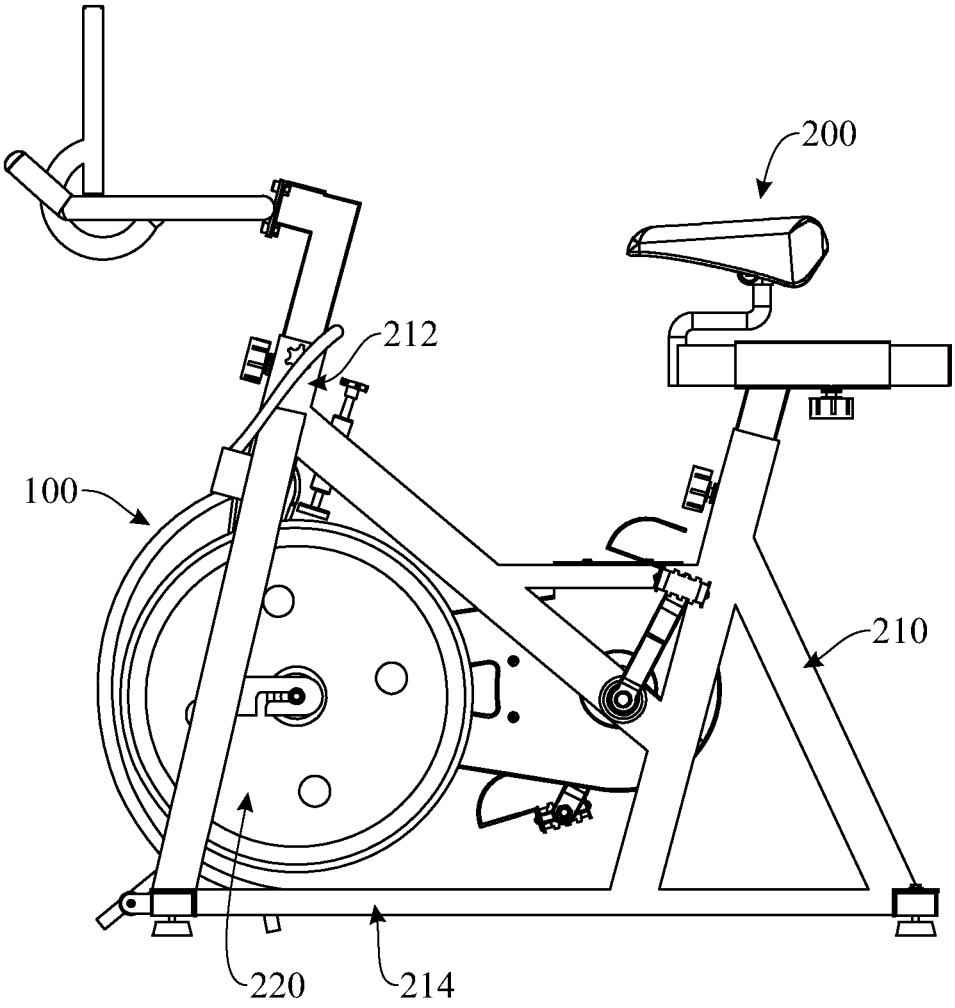
Figure 5:
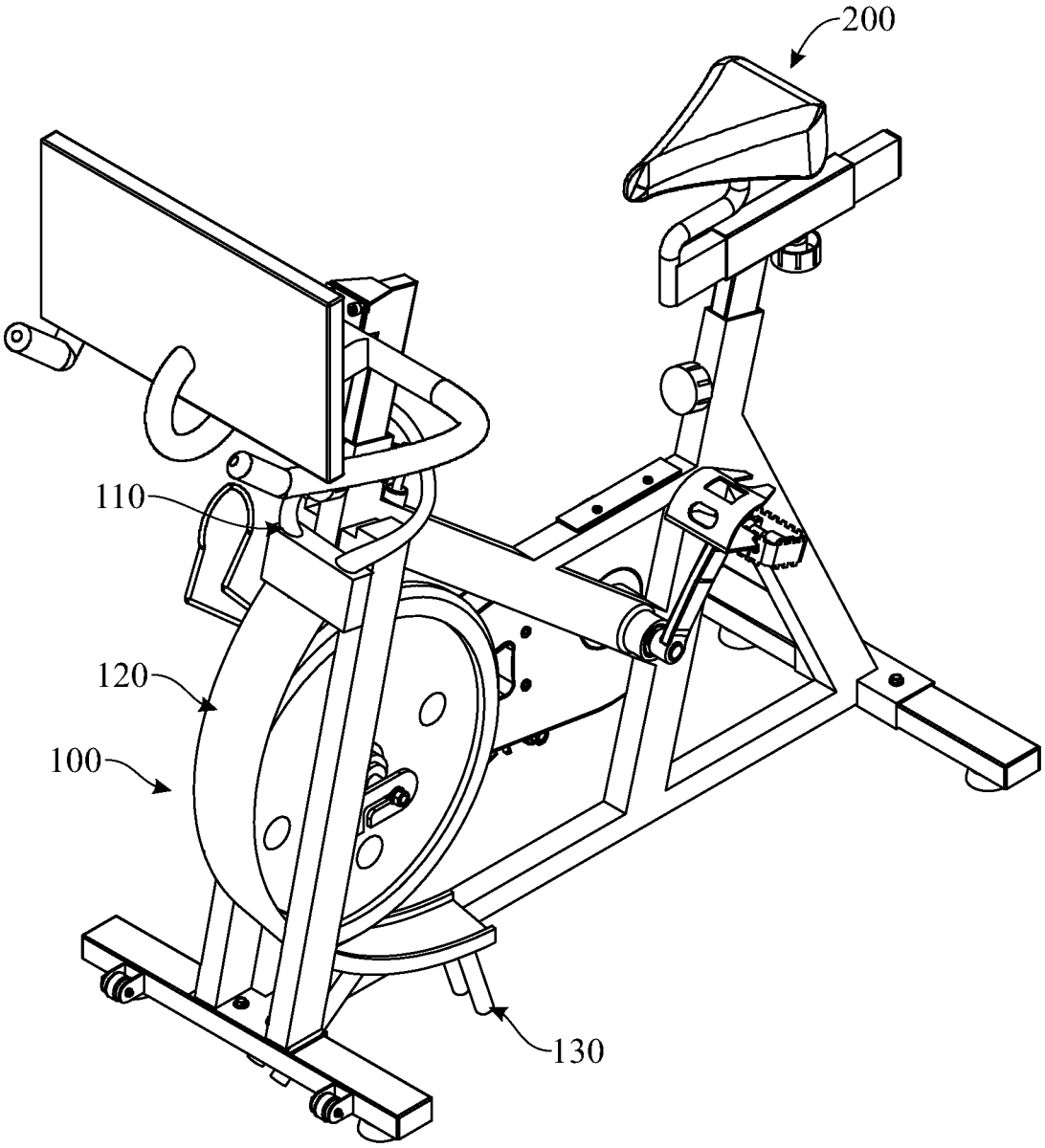

FIG. 1 presents a perspective view of a wheel guard device of the present invention;

FIG. 2 presents another perspective view of the wheel guard device of the present invention;

FIG. 3 presents a side view showing that the wheel guard device of the present invention is to be used for a stationary exercise bicycle;

FIG. 4 presents a side view showing that the wheel guard device of the present invention is attached to the stationary exercise bicycle; and FIG. 5 presents a perspective view showing that the wheel guard device of the present invention is attached to the stationary exercise bicycle.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate.

Referring initially to FIGS. 1-5, the present invention is directed toward a wheel guard device 100, and more particularly, to a wheel guard device 100 for a stationary exercise bicycle 200.

In an embodiment of the present invention, the wheel guard device 100 comprises a coupling module 110, a shielding module 120 and a supporting module 130.

In this embodiment of the present invention, the shielding module 120 is connected in between the coupling module 110 and the supporting module 130; in other words, the coupling module 110 and the supporting module 130 are oppositely located with each other along the shielding module 120.

In this embodiment of the present invention, the coupling module 110 is configured to be connected with an upper portion 212 of a bicycle frame 210 of the stationary exercise bicycle 200.

In this embodiment of the present invention, the shielding module 120 is configured to at least partially surround a bicycle wheel 220 of the stationary exercise bicycle 200 with a predetermined distance from the bicycle wheel 220 of the stationary exercise bicycle 200.

Accordingly, in this embodiment of the present invention, the shielding module 120 is capable of preventing a person or an animal from touching the bicycle wheel 220 that is exposed and is spinning (i.e., undesirable contact).

Accordingly, in this embodiment of the present invention, the shielding module 120 is capable of preventing an object from contacting the bicycle wheel 220 that is exposed and is spinning.

In this embodiment of the present invention, the shielding module 120 may be transparent or opaque. In one exemplary embodiment, the shielding module 120 may be permeable. For instance, the shielding module 120 may be made out of a wire mesh or other rigid permeable material that allows airflow to pass through the shielding module that would otherwise have a negative impact on a user's performance utilizing the stationary exercise when the shielding module shields the bicycle wheel.

In this embodiment of the present invention, in an aspect, the supporting module 130 is configured to be placed on a ground or a mounting/supporting surface.

In this embodiment of the present invention, in another aspect, the supporting module 130 is configured to be connected with a lower portion 214 of the bicycle frame 210 of the stationary exercise bicycle 200.

In this embodiment of the present invention, the coupling module 110 comprises a strap element 112. The strap element 112 is made of a flexible material, such as nylon. The strap element 112 is configured to be connected with the upper portion 212 of the bicycle frame 210 of the stationary exercise bicycle 200. Specifically, the strap element 112 is a flexible loop which is used to be sleeved onto the upper portion 212 of the bicycle frame 210 of the stationary exercise bicycle 200. In one exemplary embodiment, the strap element 112 may include an adjustable strap, such that the length of the strap of strap element 112 may be adjusted to adjust the tension in which it is attached or otherwise wrapped to the bicycle frame.

In this embodiment of the present invention, the coupling module 110 comprises a brace element 114. The brace element 114 is made of a rigid material. The brace element 114 is configured to be connected with the upper portion 212 of the bicycle frame 210 of the stationary exercise bicycle 200. Specifically, the brace element 114 comprises a rigid block with opposing arms 116 (e.g., mounting brackets) and a cavity 118, the cavity 118 traverses into the arms 114. In one exemplary embodiment, the arms 114 is used to be attached to the upper portion 212 of the bicycle frame 210 of the stationary exercise bicycle 200 while the cavity 118 is used to receive the upper portion 212 of the bicycle frame 210 of the stationary exercise bicycle 200, such that the brace element 114 is able to clamp the upper portion 212 of the bicycle frame 210 of the stationary exercise bicycle 200 and thus is able to provide support. The brace element may include a pair of adjustable opposing arms 116. In this exemplary form, the space between the opposing arms 116 may be enlarged or shortened to secure the brace element to different styles and models of bicycles.

In this embodiment of the present invention, the brace element 114 is connected in between the strap element 112 and the shielding module 120; in other words, the strap element 112 and the shielding module 120 are oppositely located with each other along the brace element 114.

In this embodiment of the present invention, the shielding module 120 comprises a shielding element 122. The shielding element 122 is made of a hard/rigid material, such as plastic. The shielding element 122 is configured to at least partially surround the bicycle wheel 220 of the stationary exercise bicycle 200. Specifically, the shielding element 122 is a rigid elongated curved plate which is used to be placed in front of the bicycle wheel 220, such as a front wheel, of the stationary exercise bicycle 200. In one exemplary embodiment, the shielding element 122 includes a body with two opposing flanges 121 extending the longitudinal peripheral edges of the body to form a protective channel 123 (FIG. 2).

In this embodiment of the present invention, the brace element 114 is connected in between the strap element 112 and the shielding element 122; in other words, the strap element 112 and the shielding element 122 are oppositely located with each other along the brace element 114.

In this embodiment of the present invention, the supporting module 130 comprises a plurality of adjustable supporting legs 132. Each of the plurality of adjustable supporting legs 132 is made of a material that is moldable in shape. In an aspect, the plurality of adjustable supporting legs 132 are used to be placed on a ground or a mounting/supporting surface. In another aspect, the plurality of adjustable supporting legs 132 are used to be connected with the lower portion 214 of the bicycle frame 210 of the stationary exercise bicycle 200.

In this embodiment of the present invention, the shielding element 122 is connected in between the brace element 114 and the plurality of adjustable supporting legs 132; in other words, the brace element 114 and the plurality of adjustable supporting legs 132 are oppositely located with each other along the shielding element 122.

Accordingly, the wheel guard device 100 of the present invention is able to cover the wheel and protects kids or any other person from getting hurt and suffering a serious injury by preventing a person or an animal from touching and an object from contacting the bicycle wheel 220 that is exposed and is spinning really fast and thus is very dangerous, so as to make the stationary exercise bicycle 200 safer for people to use.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A wheel guard device comprising:

a coupling module for coupling the wheel guard device to a stationary exercise bicycle, which coupling module consists of a brace element and a strap element and wherein the brace element of the coupling module consists of a body having opposing mounting arms and a cavity space therebetween;

a shielding module extending directly outwardly from the coupling module and wherein the brace element is directly connected in between the strap element and the shielding module; and a supporting module attachable to a distal end of the shielding module for maintaining the shielding module in a fixed position.

2. The wheel guard device of claim 1, wherein the coupling module is configured to be connected to an upper portion of a bicycle frame of the stationary exercise bicycle by the strap element.

3. The wheel guard device of claim 1, wherein the shielding module is configured to at least partially surround a bicycle wheel of the stationary exercise bicycle.

4. The wheel guard device of claim 1, wherein the shielding module partially surrounds a bicycle wheel of a stationary exercise bicycle and is positionable a predetermined distance from the bicycle wheel.

5. The wheel guard device of claim 4, wherein the predetermined distance is sufficient to allow the unencumbered rotation of the bicycle wheel while shielding the bicycle wheel from undesirable external contact.

6. The wheel guard device of claim 1, wherein the supporting module includes one or more supporting legs.

7. The wheel guard device of claim 6, wherein the supporting legs are configured to rest on a ground surface.

8. The wheel guard device of claim 1, wherein the supporting module is connectable to a lower portion of a bicycle frame of the stationary exercise bicycle.

9. The wheel guard device of claim 1, wherein the shielding module includes a curved body.

10. The wheel guard device of claim 9, wherein the curved body of the wheel guard substantially matches a portion of the stationary exercise bicycle's front wheel curvature.

11. The wheel guard device of claim 1, wherein the shielding module includes a body and a pair of longitudinal peripheral opposing flanges that form a protective channel.

12. The wheel guard device of claim 11, wherein the protective channel is configured to receive a portion of a bicycle wheel of the stationary exercise bicycle therein.

13. The wheel guard device of claim 1, wherein the shielding module is made out of permeable material.

14. The wheel guard device of claim 1, wherein the coupling module is configured to be connected to a handlebar post of the stationary exercise bicycle by the strap element.

15. The wheel guard device of claim 1, wherein the shielding module is configured to enclose the entirety of the exposed front wheel of the stationary exercise bicycle.

16. The wheel guard device of claim 1, wherein the entire shielding module is made out of a wire mesh.

* * * * *